US005197741A

United States Patent [19]

Wu

[11] Patent Number: 5,197,741

[45] Date of Patent: Mar. 30, 1993

[54] ELECTRICALLY LIGHTABLE CHESS PIECE

[76] Inventor: Liung M. Wu, No. 22, Yun Ler Street, Inn Ko, Taoyuan, Taiwan

[21] Appl. No.: 885,373

[22] Filed: May 19, 1992

[51] Int. Cl.[5] ..... A63F 3/00

[52] U.S. Cl. ..... 273/237; 273/288; 273/239; 362/206

[58] Field of Search ..... 273/239, 288, 237; 362/206, 386, 398, 392, 202, 205, 253, 286, 295; 200/60, 61

[56] References Cited

U.S. PATENT DOCUMENTS

| | | | |
|---|---|---|---|
| 2,673,404 | 3/1954 | Abrahamson | 273/239 |
| 3,389,913 | 6/1968 | Tunstall | 273/239 |
| 3,984,109 | 10/1976 | Wiles | 273/288 |

*Primary Examiner*—James C. Yeung

*Attorney, Agent, or Firm*—Morton J. Rosenberg; David I. Klein

[57] ABSTRACT

An electrically lit chess piece includes a chess body which is coupled to a transparent cap at the top end and contains an internal battery housing. The battery housing includes a bulb positioned under the transparent cap and a magnet having springs at the bottom section. When the chess piece is placed on a metallic chessboard, the magnet is displaced in a downward direction and the bulb is lit. When the chess piece is removed from the chessboard, the magnet is pulled in an upward displacement by the springs and disconnects an electrical circuit for turning the light bulb off.

1 Claim, 4 Drawing Sheets

ELECTRICALLY LIGHTABLE CHESS PIECE

BACKGROUND OF THE INVENTION

This invention relates to chess games where chess pieces may be electrically lit when the chess piece is mounted on a chessboard and is automatically unlit when the chess piece is removed from the chessboard.

PRIOR ART

Chess pieces composed of wood or plastic having basic configurations such as the contour of a King, a Queen, or a Knight are well known in the art. Further, it is known to have chess pieces provided with magnets mounted therein for attraction to a metal chessboard in order that users may play the chess game when they are on vehicles such as buses or trains.

SUMMARY OF THE INVENTION

A primary object of the present invention is to provide electrically lightable chess pieces which are provided with light bulbs in the chess bodies. As a chess piece is placed on a chess board, the bulb in the chess piece body is lit to provide a pleasing aesthetic effect.

Another object of the present invention is to provide an improved chess piece which includes a battery, a magnet, and a spring provided inside the chess body such that when the chess piece is removed from the chessboard, the spring pulls the magnet upward and the circuit between the battery and the bulb is opened to turn the bulb off. By noting the state of the bulb being lit or unlit, one can decide that one has to move that chess piece in accordance with the rules of chess.

Further, objectives and advantages of the present invention will become apparent as the following description proceeds, and the features of novelty are characterized in claims annexed to and forming a part of this invention.

DESCRIPTION OF THE PREFERRED EMBODIMENTS

Figure 1:
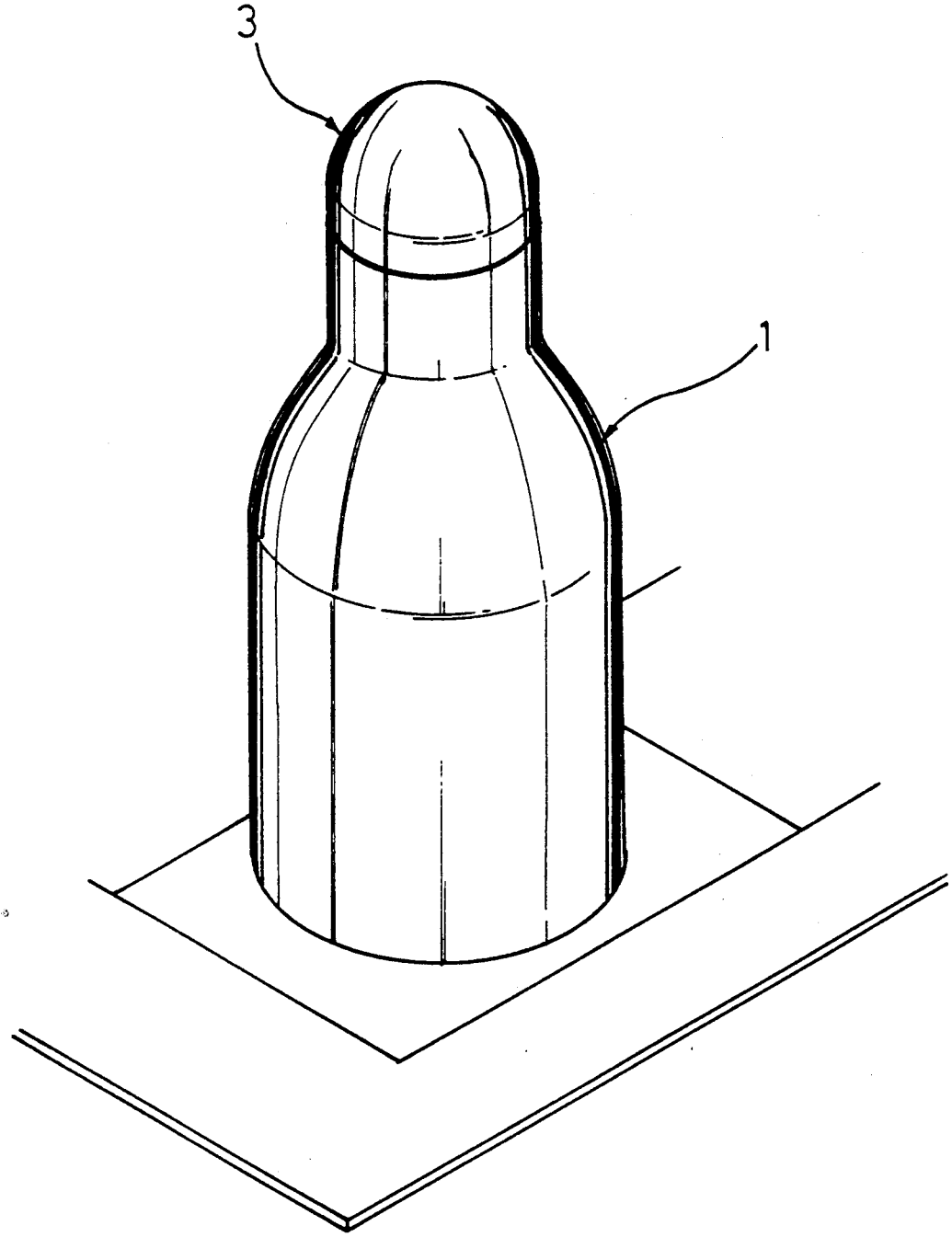
FIG. 1 is a perspective view of the chess piece in accordance with the present invention.
Figure 2:
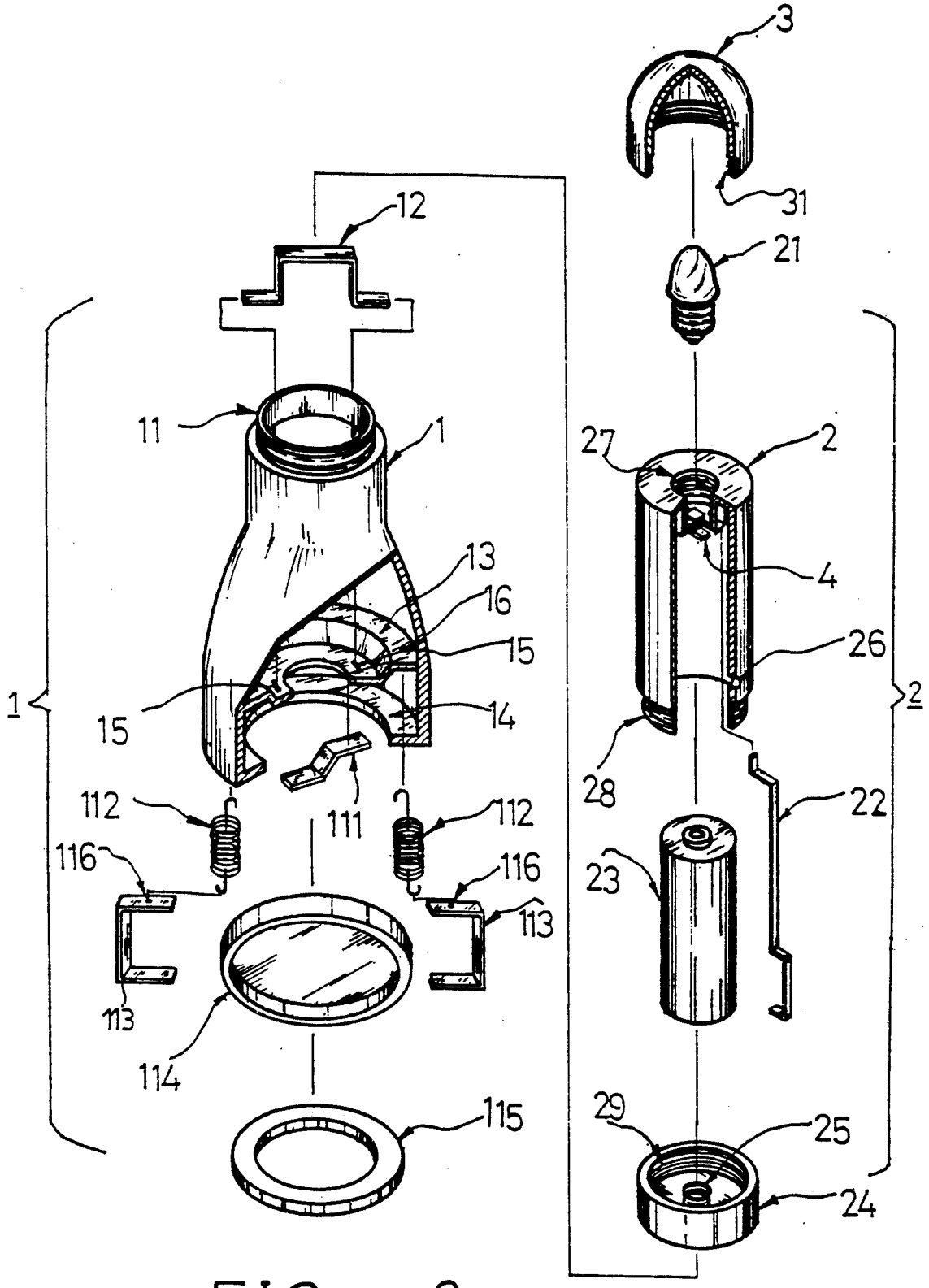
FIG. 2 is an exploded view of the chess piece shown in FIG. 1 in accordance with the present invention.
Figure 3:
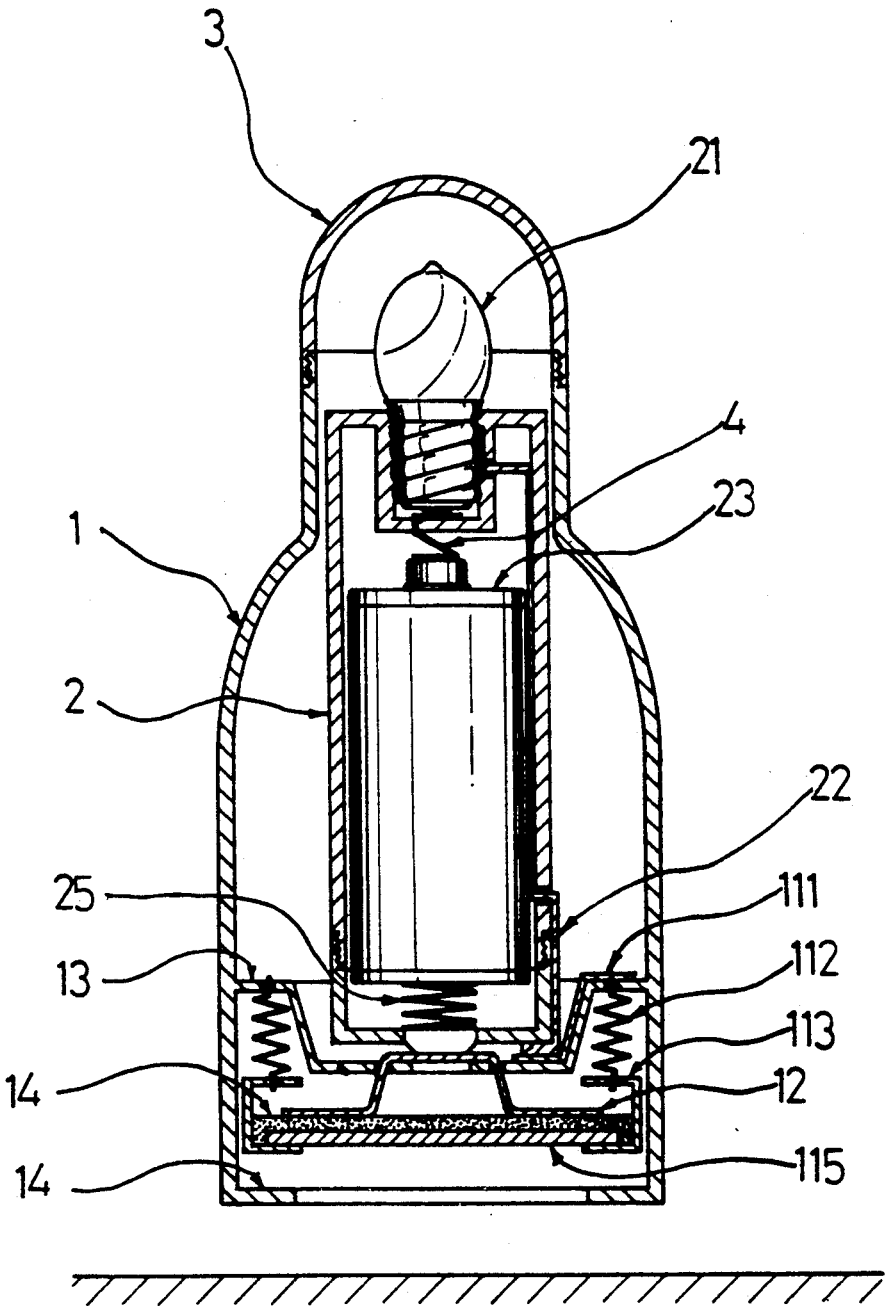
FIG. 3 is a cross-sectional view of the chess piece when the light bulb in the chess body is unlit according to the present invention; and, FIG. 4 is a cross-sectional view when the light bulb in the chess body is lit on a chessboard according to the present invention.

Referring now to FIGS. 1-3, it can be seen that the present invention includes a chess body 1 having an internal chamber and a transparent cap 3 for mounting on an upper end of chess body 1. A battery housing 2 is received in the interior of chess body 1. The upper end of the chess body 1 is provided with threads 11 to threadedly engage with inner threads 31 of the cap 3. A middle plate member 13 is mounted in the body 1 and has a first set of openings 15 and a second set of openings 16 symmetrically formed through middle plate member 13 as shown. A metallic piece member 12 is provided at the bottom of the middle plate member 13 passing through openings 15 and a connective piece 111 is placed on an upper surface of the plate member 13. Two springs 112 are connected to the middle plate member 13 through the openings 16 at their upper ends. Two U-shaped metallic pieces 113 are connected with the lower ends of the two springs 112 through holes 116. An isolation plate 114 is secured to magnet 115 in combined fashion and is located between the two U-shaped pieces 113. The battery housing 2 includes a top threaded receiver 27 to threadedly engage a light bulb 21. A conductor 4 is located at the bottom of the receiver 27. A battery 23 is mounted inside the housing 2 and includes a base 24 having conductive spring 25 engaged with the housing 2 by the threads 29 and 28. A conductive rod 22 is mounted along the battery housing 2, an upper section of which is interal the housing 2 for electrical contact with the bulb 21 and a lower section passes through a hole 26 of the housing 2 external housing 2 for contact with the connective piece 111.

Figure 4:
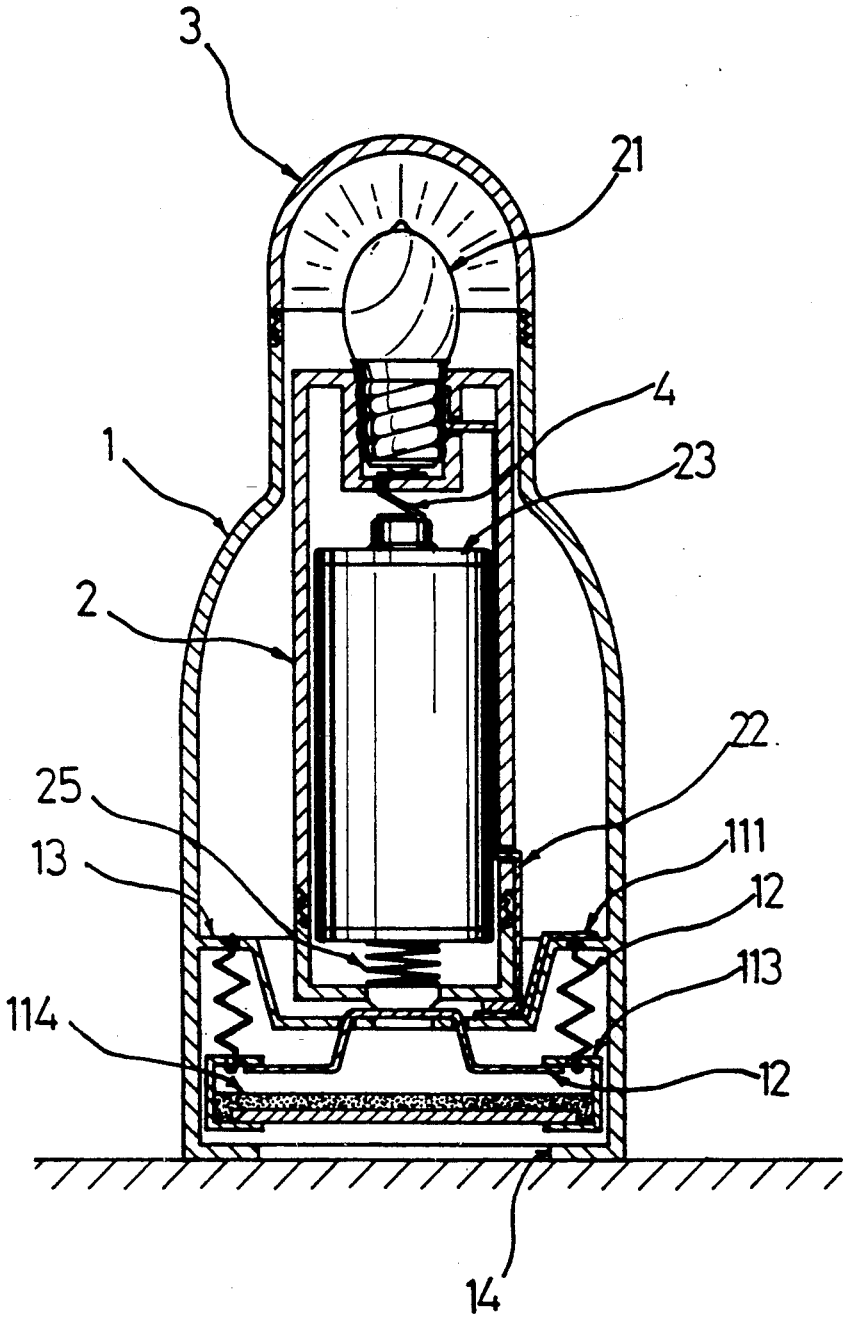

As shown in FIG. 3, the bulb 21 will not be lit when the chess piece is removed from the chessboard because the electrical circuit between the positive pole and negative pole of the battery 23 is disconnected. If chess body 1 is mounted on a chessboard as is shown in FIG. 4, the magnet 14 will move downward and contact a leg of pieces 113 and respectively displace the U-shaped pieces 113. When the U-shaped metallic pieces 113 contact with metallic piece 12, the electrical circuit therebetween is connected from the negative pole of the battery 23, through the spring 25, through the metallic piece 12, through the U-shaped piece 113, through the spring 112, the connective piece 111, the conductive rod 22, the bulb 21, and conductor 4 back to the positive pole of the battery 23. In this manner, the bulb 21 is lit. When the chess piece is picked up from the chess board, the springs 112 will pull the U-shaped pieces 113 upward out of contact with the metallic piece 12. The electrical circuit is then opened and the bulb is turned off.

It is to be understood that the present invention is to provide a new structure of a chess piece which is capable of being turned on or off or being lit or unlit by placing the chess piece on the chessboard or by picking it up.

As various possible embodiments may be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. An electrically lightable chess piece capable of being lit when mounted on a chessboard comprising:

(a) a chess piece body having an internal chamber for insert of a battery housing containing a battery for electrical contact with a light bulb;

(b) a transparent cap having inner cap threads for threaded engagement with cooperative threads formed on an upper end of said chess piece body;

(c) a middle plate member secured to an internal surface of said chess piece body, said middle plate member having a first pair of openings formed through a base thereof and a second pair of openings formed through a shoulder section thereof;

(d) a metallic piece member having a substantially U-shaped contour defining a pair of metallic piece leg members extending through said first pair of openings;

(e) an electrically connective member mounted to an upper surface of said middle plate member;

(f) a pair of U-shaped metallic elements displaceable within said chess piece body;

(g) a pair of springs secured to a leg member of each of said U-shaped metallic elements on one end thereof and to said middle plate member on an opposing end thereof; at least one of said spring members passing through one opening of said second pair of openings for contacting said electrically connective member;

(h) a magnet having an insulated plate member fixedly secured to an upper surface thereof, said magnet being displaceable between opposing leg members of said U-shaped metallic members; and, (i) a conductive rod member positioned on said battery housing for contacting a metal lead on said light bulb and said electrically connective member at opposing ends thereof, whereby when said chess piece is mounted on said chessboard said magnet displaces said U-shaped metallic elements into contact with said metallic piece member to complete an electrical circuit between said battery and said light bulb.

* * * * *